US009316464B2

(12) United States Patent
Frederick

(10) Patent No.: US 9,316,464 B2
(45) Date of Patent: Apr. 19, 2016

(54) FIREARM LEAD SIGHT

(71) Applicant: Aaron Wade Frederick, West Liberty, KY (US)

(72) Inventor: Aaron Wade Frederick, West Liberty, KY (US)

( * ) Notice: Subject to any disclaimer, the term of this patent is extended or adjusted under 35 U.S.C. 154(b) by 0 days.

(21) Appl. No.: 14/340,630

(22) Filed: Jul. 25, 2014

(65) Prior Publication Data

US 2015/0027027 A1 Jan. 29, 2015

Related U.S. Application Data

(60) Provisional application No. 61/858,697, filed on Jul. 26, 2013.

(51) Int. Cl.
*F41G 1/473* (2006.01)
*F41G 11/00* (2006.01)

(52) U.S. Cl.
CPC ..... *F41G 11/004* (2013.01); *F41G 1/473* (2013.01)

(58) Field of Classification Search
CPC ..... F41G 1/473; F41G 1/02; F41G 1/033; F41G 1/06; F41G 1/08; F41G 1/10; F41G 1/12; F41G 1/18
USPC ..... 42/141
See application file for complete search history.

(56) References Cited

U.S. PATENT DOCUMENTS

| | | | | | |
|---|---|---|---|---|---|
| 752,962 | A * | 2/1904 | Eby | 42/141 |
| 846,173 | A * | 3/1907 | Wise | 42/139 |
| 1,421,553 | A * | 7/1922 | Pohl | 42/141 |
| 1,625,060 | A * | 4/1927 | Storm | 42/141 |
| 2,056,469 | A * | 10/1936 | King | 42/140 |
| 2,127,173 | A * | 8/1938 | Hunt | 42/137 |
| 2,386,420 | A * | 10/1945 | Bailey et al. | 42/141 |
| 2,519,220 | A * | 8/1950 | Bentley | 42/141 |
| 2,613,442 | A * | 10/1952 | Austin | 42/139 |
| 2,781,583 | A * | 2/1957 | Grimble | 42/144 |
| 2,904,888 | A * | 9/1959 | Niesp | 42/141 |
| 4,006,531 | A * | 2/1977 | Kwako | 42/141 |
| 4,112,583 | A * | 9/1978 | Castilla | 42/141 |
| 4,223,446 | A * | 9/1980 | Villa | 42/141 |
| 4,937,944 | A * | 7/1990 | Montalvo | 42/141 |
| 5,067,244 | A * | 11/1991 | Montalvo | 42/141 |
| 2005/0086848 | A1 * | 4/2005 | Dietz | 42/130 |
| 2013/0174465 | A1 * | 7/2013 | Martinez | 42/139 |

* cited by examiner

*Primary Examiner* — Joshua Freeman

(57) ABSTRACT

A firearm lead sight that is attached to the barrel of a firearm for assisting a shooter in leading a moving target. The firearm lead sight includes a mount, a first sight assembly, and a second sight assembly. A mount plate and a barrel grip form the mount and are clamped around the barrel of the firearm. A first sight bar and a second sight bar, of the first sight assembly and the second sight assembly respectively, are pivotally connected to the mount plate opposite each other. A first plurality of sight marks is positioned along the first sight bar, while a second plurality of sight marks is positioned along the second sight bar. A first detent of the first sight bar and a second detent of the second sight bar allow the first sight bar and the second sight bar to be locked in a variety of positions.

11 Claims, 9 Drawing Sheets

FIREARM LEAD SIGHT

The current application claims a priority to the U.S. Provisional Patent application Ser. No. 61/858,697 filed on Jul. 26, 2013.

FIELD OF THE INVENTION

The present invention relates generally to firearm accessories and more particularly, firearm sights. More specifically, the present invention is an attachable, deployable, and adjustable firearm lead sight with multiple sight beads that allow a shooter to compensate for target movement.

BACKGROUND OF THE INVENTION

When operating a firearm, a shooter is often faced with the difficult task of shooting and hitting a moving target. This is commonly encountered in hunting as hunters must quickly shoot moving animals such as deer and birds before the animals are able to escape or get out of range. There are typically two techniques that shooters may use when shooting a moving target. The first technique is generally referred to as "leading" or "tracking" and involves following the movement of the target. After the shooter has become familiar with the movement of the target, the firearm sights are placed at the required distance in front of the moving target and the shot is fired. This technique allows the shooter more time to concentrate on the lead prior to the shot as well as study the speed and movement of the target for a more accurate shot. The leading/tracking technique is by far the most commonly used method of shooting a moving target. The second technique is generally referred to as "snap-shooting" or "catching" and involves placing the firearm sights ahead of the target by the required distance. The shooter holds the sights in this position in front of the target as the shot is fired. This technique can be considered a reflex move in which the shooter quickly places the sights in a position ahead of the target and fires when the animal should reach that position. The present invention seeks to enhance and improve upon currently existing techniques for shooting moving targets.

The present invention is a firearm lead sight that is attachable to the barrel or rib of a firearm such as a shotgun or rifle with the intent of aiding a shooter in shooting a moving target. In the preferred embodiment, the present invention comprises a mount, having a mount plate and a barrel grip, that is attached and secured around the barrel/rib of a firearm. The mount plate serves as a mounting base for a first sight bar and a second sight bar that may be deployed to the left and right of the barrel. Each sight bar comprises a plurality of sight beads that complement the existing front sight bead of the barrel. The first sight bar and the second sight bar may be partially or fully deployed when leading a moving target, allowing adjustments to be made to the lead. The mount is capable of sliding forward and backward on the barrel as well for further adjustments. The plurality of sight beads allow a shooter to maintain a consistent lead on a moving target instead of attempting to manually estimate the lead. Each of the plurality of sight beads is threaded and screwed into place to allow a shooter to utilize custom sight beads if desired. When the firearm lead sight is not in use, the first sight bar and the second sight bar may be folded into alignment with the barrel.

The object of the present invention is to facilitate the technique of leading a moving target. The present invention allows a shooter to compensate for a target's movement in both the right and left directions. The shooter may utilize the left sights for a target that is moving in the right direction and the right sights for a target that is moving in the left direction. The appropriate sight bead is aligned with and held in place on the moving target. This ensures that the firearm barrel is oriented at the proper distance ahead of the moving target as the shot is fired.

DETAIL DESCRIPTIONS OF THE INVENTION

All illustrations of the drawings are for the purpose of describing selected versions of the present invention and are not intended to limit the scope of the present invention.

The present invention is a firearm lead sight that assists a shooter in shooting a moving target. The present invention is retro fit attachment for firearms and can be designed to be integrated with any type of firearm. The firearm lead sight comprises a mount 10, a first sight assembly 20, and a second assembly. The mount 10 provides a means for attaching the present invention to the barrel of a firearm and supports both the first sight assembly 20 and the second sight assembly 30. The first sight assembly 20 and the second sight assembly 30 provide indicators for leading a moving target while shooting.

Figure 1:
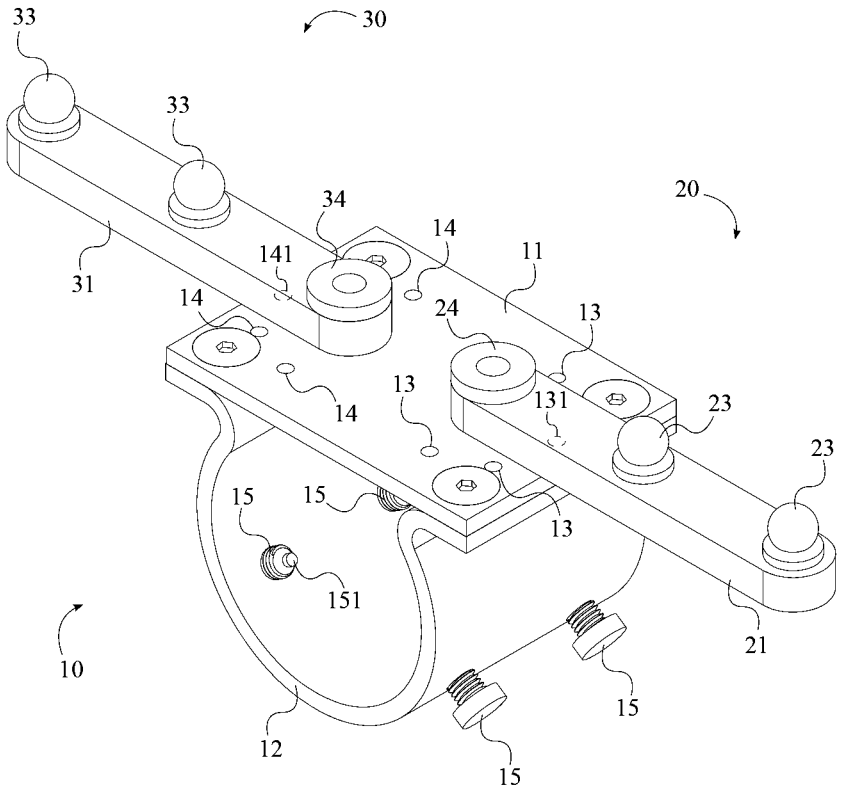
FIG. 1 is a perspective view of the present invention, wherein the first sight bar and the second sight bar are in the deployed position.
Figure 9:
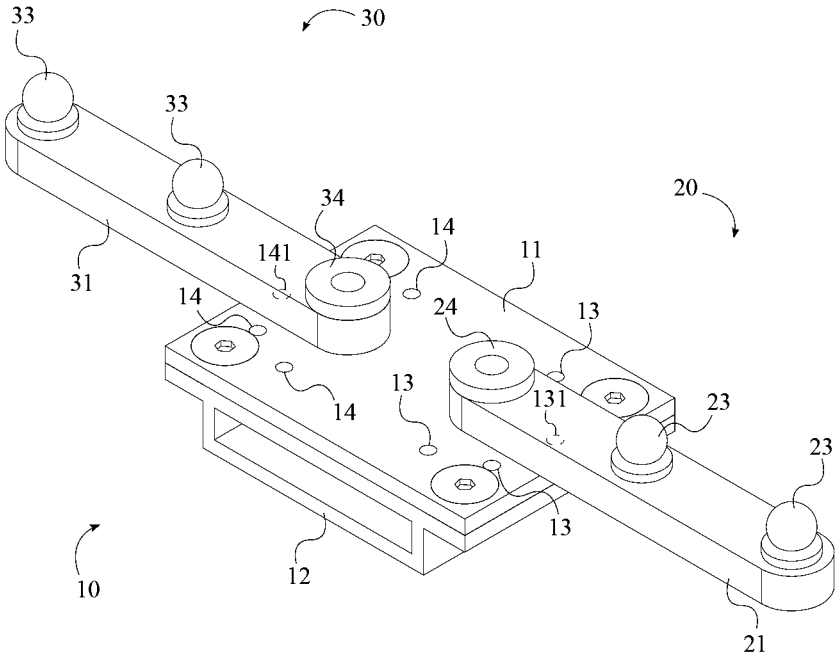
FIG. 9 is a perspective view of the present invention, wherein the barrel grip is designed to clamp around the rib of a firearm.

In reference to FIG. 1, the mount 10 comprises a mount plate 11, a barrel grip 12, a plurality of first notches 13, and a plurality of second notches 14. The barrel grip 12 is adjacently attached to the mount plate 11, wherein the barrel grip 12 and mount plate 11 form an enclosure to clamp around the barrel of a firearm. In the preferred embodiment of the present invention, the mount plate 11 is a flat, rectangular piece, while the barrel grip 12 is contoured to match the shape of the barrel of the firearm (e.g. a single barrel, double barrel, etc.). It is also possible for the barrel grip 12 to be designed to clamp around the rib of a firearm, as shown in FIG. 9. The barrel grip 12 is removable from the mount plate 11, such that the present invention may be easily swapped and used with firearms having similar barrels.

In the preferred embodiment of the present invention, the barrel grip 12 is attached to the mount plate 11 by a plurality of screws. The plurality of screws traverses through the mount plate 11 and into the barrel grip 12. The plurality of screws may be secured in place by threading bored into the barrel grip 12 or by a plurality of nuts, wherein the barrel grip 12 is secured to the mount plate 11 on either side of the barrel of the firearm. It is also possible for the barrel grip 12 to be secured to the mount plate 11 in any other way, such as through a snap fit attachment. Additionally, it is possible for the barrel grip 12 to be hingedly connected to the mount plate 11 about one end, such that only one end of the barrel grip 12 and the mount plate 11 must be secured together.

Figure 2:
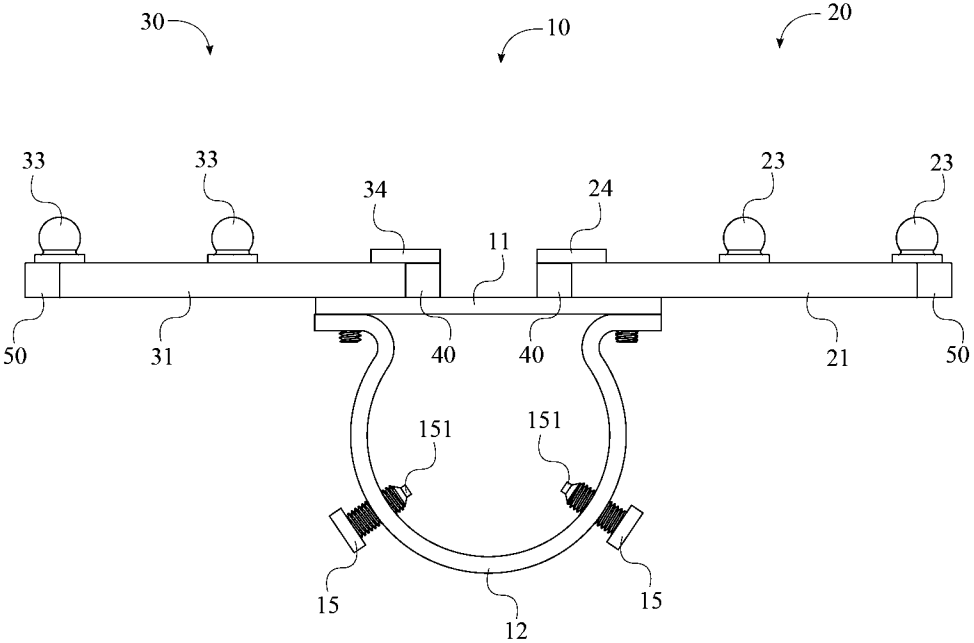
FIG. 2 is a front elevational view of the present invention, wherein the first sight bar and the second sight bar are in the deployed position.

In reference to FIG. 2, the first sight assembly 20 comprises a first sight bar 21 and a first plurality of sight marks 23; the first sight bar 21 having a proximal end 40 and distal end 50. The first sight bar 21 is pivotally connected to the mount plate 11; more specifically, the proximal end 40 of the first sight arm is pivotally connected to the mount plate 11, wherein the distal end 50 of the first sight bar 21 is a free end, detached from the mount plate 11. Each of the first plurality of sight marks 23 is adjacently attached to the first sight bar 21; the first plurality of sight beads being positioned along the first sight bar 21. The design of the first plurality of sight marks 23 is not limited with respect to shape or size and shooters are able to quickly and conveniently swap out each of the first plurality of sight marks 23 based on preference.

Figure 3:
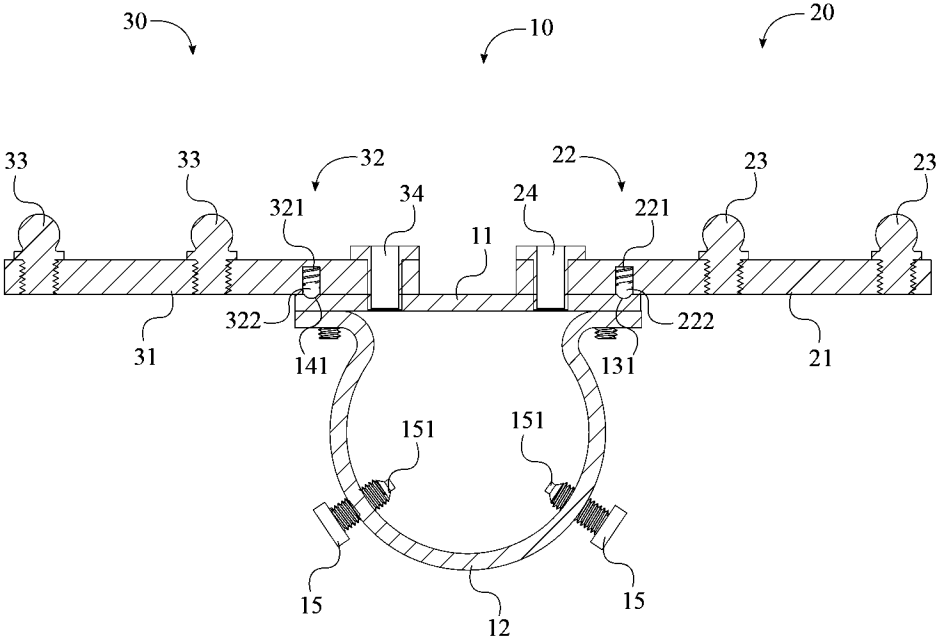
FIG. 3 is a front sectional view of the present invention, wherein the first sight bar and the second sight bar are in the deployed position.
Figure 6:
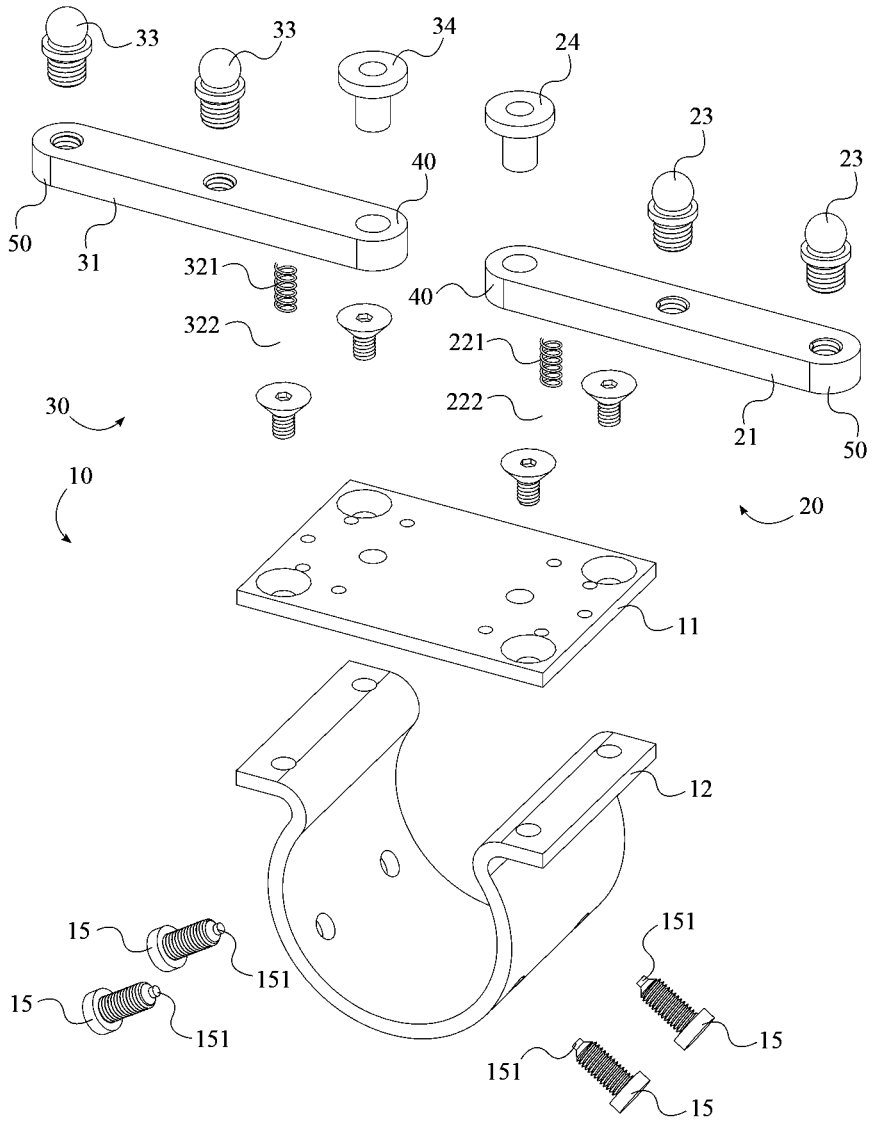
FIG. 6 is an exploded view of the present invention.

In reference to FIG. 3 and FIG. 6, in the preferred embodiment of the present invention, each of the first plurality of sight marks 23 is threaded into the first sight bar 21. In this way, the shooter can customize the spacing between each of the first plurality of sight marks 23 to his or her preferred configuration by removing particular sight marks. Ideally, the provided mount 10 points for attaching the first plurality of sight marks 23 are spaced in equal increments. It is also possible for the first plurality of sight marks 23 to be attached to the first sight bar 21 in any other way, such as through a snap fit attachment.

Figure 4:
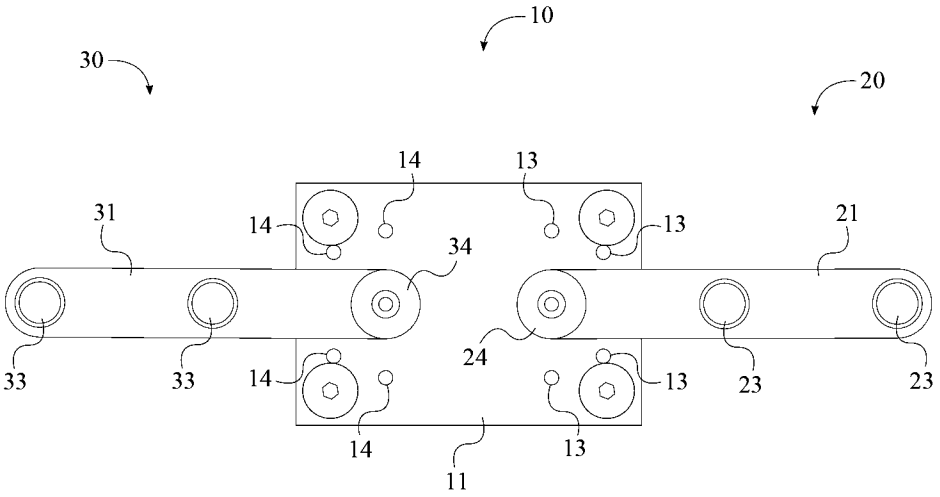
FIG. 4 is a top plan view of the present invention, wherein the first sight bar and the second sight bar are in the deployed position.
Figure 7:
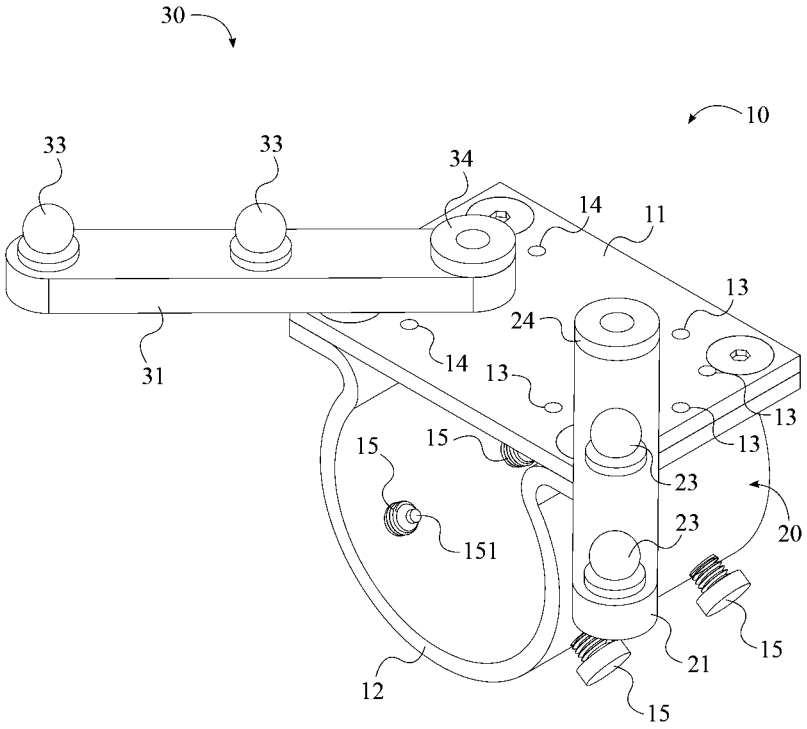
FIG. 7 is a perspective view of the present invention, wherein the first sight bar and the second sight bar are in an intermediate position.
Figure 8:
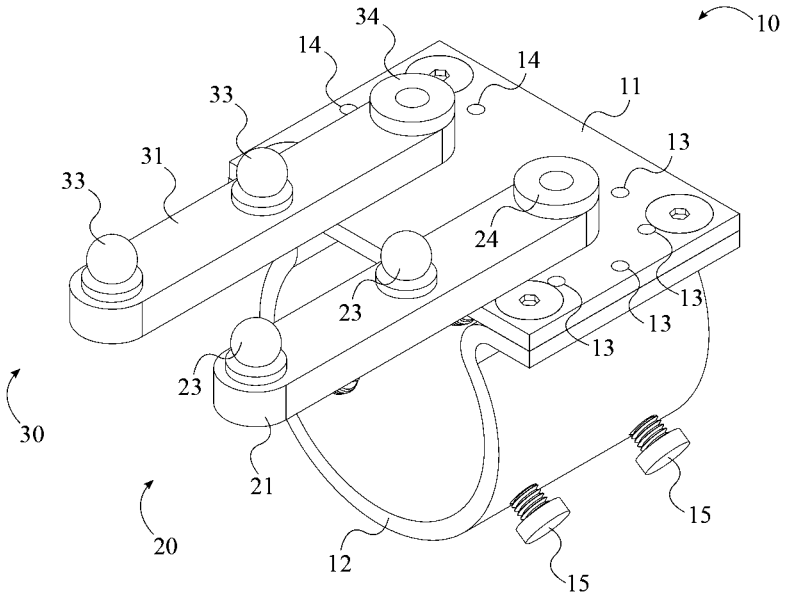
FIG. 8 is a perspective view of the present invention, wherein the first sight bar and the second sight bar are in a retracted position.

In reference to FIG. 2 and FIG. 4, the first sight bar 21 comprises a first detent 22, wherein the first detent 22 is designed to engage the plurality of first notches 13. The plurality of first notches 13 is positioned into the mount plate 11 and radially positioned about the proximal end 40 of the first sight bar 21. The first sight bar 21 can be pivoted about the mount plate 11, wherein the first detent 22 can be made to engage a specific first notch 131 from the plurality of first notches 13 in order to set the first sight bar 21 in the desired position. The first sight bar 21 can be set in a deployed position, as shown in FIG. 1, wherein the first sight bar 21 is positioned perpendicular to the barrel of the firearm; a retracted position, as shown in FIG. 8, wherein the first sight bar 21 is positioned parallel to the barrel of the firearm; or one or more intermediate positions between the deployed position and the retracted position, as shown in FIG. 7.

In reference to FIG. 3, in the preferred embodiment of the present invention, the first detent 22 comprises a first spring 221 and a first ball 222. The first spring 221 is positioned into the first sight bar 21 and the first ball 222 is positioned adjacent to the spring. When the first sight arm is set in the deployed position, the retracted position, or an intermediate position, the first ball 222 engages the specific first notch 131, thus securing the first sight bar 21 in place. When sufficient force is applied to the first sight bar 21, the first ball 222 is pressed into the first spring 221, wherein the spring compresses and the first ball 222 is pressed into the first sight bar 21 allowing the first sight bar 21 to pivot about the mount plate 11.

In reference to FIG. 2, the second sight assembly 30 comprises a second sight bar 31 and a second plurality of sight marks 33; the second sight bar 31 having a proximal end 40 and distal end 50. The second sight bar 31 is pivotally connected to the mount plate 11; more specifically, the proximal end 40 of the second sight arm is pivotally connected to the mount plate 11, wherein the distal end 50 of the second sight bar 31 is a free end, detached from the mount plate 11. Each of the second plurality of sight marks 33 is adjacently attached to the second sight bar 31; the second plurality of sight beads being positioned along the second sight bar 31. The design of the second plurality of sight marks 33 is not limited with respect to shape or size and shooters are able to quickly and conveniently swap out each of the second plurality of sight marks 33 based on preference.

In reference to FIG. 3 and FIG. 6, in the preferred embodiment of the present invention, each of the second plurality of sight marks 33 is threaded into the second sight bar 31. In this way, the shooter can customize the spacing between each of the second plurality of sight marks 33 to his or her preferred configuration by removing particular sight marks. Ideally, the provided mount 10 points for attaching the second plurality of sight marks 33 are spaced in equal increments. It is also possible for the second plurality of sight marks 33 to be attached to the second sight bar 31 in any other way, such as through a snap fit attachment.

In reference to FIG. 2 and FIG. 4, the second sight bar 31 comprises a second detent 32, wherein the second detent 32 is designed to engage the plurality of second notches 14. The plurality of second notches 14 is positioned into the mount plate 11 and radially positioned about the proximal end 40 of the second sight bar 31. The second sight bar 31 can be pivoted about the mount plate 11, wherein the second detent 32 can be made to engage a specific second notch 141 from the plurality of second notches 14 in order to set the second sight bar 31 in the desired position. The second sight bar 31 can be set in a deployed position, as shown in FIG. 1, wherein the second sight bar 31 is positioned perpendicular to the barrel of the firearm; a retracted position, as shown in FIG. 8, wherein the second sight bar 31 is positioned parallel to the barrel of the firearm; or one or more intermediate positions between the deployed position and the retracted position, as shown in FIG. 7.

In reference to FIG. 3, in the preferred embodiment of the present invention, the second detent 32 comprises a second spring 321 and a second ball 322. The second spring 321 is positioned into the second sight bar 31 and the second ball 322 is positioned adjacent to the spring. When the second sight arm is set in the deployed position, the retracted position, or an intermediate position, the second ball 322 engages the specific second notch 141, thus securing the second sight bar 31 in place. When sufficient force is applied to the second sight bar 31, the second ball 322 is pressed into the second spring 321, wherein the spring compresses and the second ball 322 is pressed into the second sight bar 31 allowing the second sight bar 31 to pivot about the mount plate 11.

In reference to FIG. 2, the first sight bar 21 and the second sight bar 31 are positioned opposite each other across the mount plate 11. In the preferred embodiment of the present invention, the first sight bar 21 and the second sight bar 31 are positioned on the mount plate 11 opposite the barrel grip 12, wherein the plurality of first notches 13 and the plurality of second notches 14 are positioned into the mount plate 11 opposite the barrel grip 12. In an alternative embodiment of the present invention, the first sight bar 21 and the second sight bar 31 are positioned in between the mount plate 11 and the barrel grip 12, wherein the plurality of first notches 13 and the plurality of second notches 14 may be positioned into either the mount plate 11 or the barrel grip 12.

In reference to FIG. 1 and FIG. 3, the first sight bar 21 and the second sight bar 31 are pivotally connected to the mount plate 11 by a first flanged bushing 24 and a second flanged bushing 34 respectively. The first flanged bushing 24 traverses through the first sight bar 21 into the mount plate 11 and provides a smooth shaft about which the first sight bar 21 may pivot. The first sight bar 21 is secured between the flange of the first flanged bushing 24 and the mount plate 11. Similarly, the second flanged bushing 34 traverses through the second sight bar 31 into the mount plate 11 and provides a smooth shaft about which the second sight bar 31 may pivot. The second sight bar 31 is secured between the flange of the second flanged bushing 34 and the mount plate 11.

Figure 5:
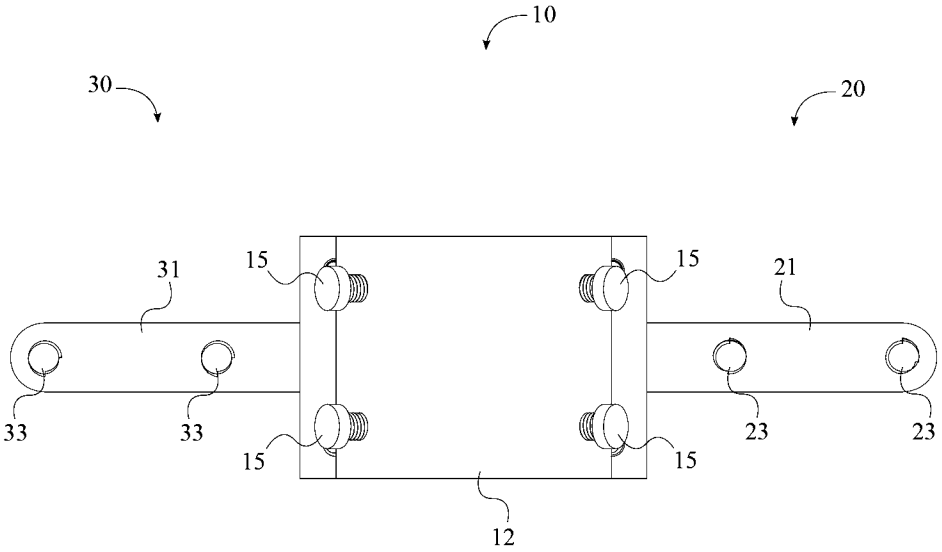
FIG. 5 is a bottom plan view of the present invention, wherein the first sight bar and the second sight bar are in the deployed position.

In reference to FIG. 2 and FIG. 5, the mount 10 further comprises a plurality of set screws 15. Each of the plurality of set screws 15 traverses through the barrel grip 12 and engages the barrel of the firearm in order to secure the present invention to the barrel and ensure that the present invention is not able to freely slide or rotate about the barrel. Each of the plurality of set screws 15 comprises a soft tip 151. The soft tip 151 of each of the plurality of set screws 15 engages the barrel of the firearm and provides enhanced grip without causing damage to the finish of the firearm.

In order to use the present invention, the mount 10 is first secured to the barrel of the firearm. If the barrel is small enough, the mount 10 may be positioned around the barrel without removing the barrel grip 12 from the mount plate 11. The mount plate 11 is centrally aligned with the firearm and each of the plurality of set screws 15 is then tightened in order to secure the mount 10 in place along the barrel. The first sight bar 21 and the second sight bar 31 can then be set in the deployed position or in an intermediate position. The first sight bar 21 and the second sight bar 31 can then be used to assist the shooter in leading a target while shooting. For a target moving to the right, the sight bar on the left side of the barrel is used to lead the target and for a target moving to the left, the sight bar on the right side of the barrel is used to lead the target.

While tracking a target, the appropriate sight bead is aligned with the moving target in order to orient the firearm barrel at the appropriate lead location ahead of the target. This allows the shooter to directly compensate for the target's movement and maintain the firearm barrel at a consistent lead ahead of the target. The first plurality of sight marks 23 and the second plurality of sight marks 33 assist the shooter in determining how far he or she should lead the target, depending on the distance between the shooter and the target. Major adjustments for orienting the first plurality of sight marks 23 and the second plurality of sight marks 33 are made by sliding the mount 10 forward or backward along the length of the firearm barrel. Minor adjustments for orienting the first plurality of sight marks 23 and the second plurality of sight marks 33 are made by adjusting the position of the first sight bar 21 and the second sight bar 31 relative to the mount 10.

Although the invention has been explained in relation to its preferred embodiment, it is to be understood that many other possible modifications and variations can be made without departing from the spirit and scope of the invention as hereinafter claimed.

What is claimed is:

1. A firearm lead sight comprises:

a mount;

a first sight assembly;

a second sight assembly;

the mount comprises a mount plate and a barrel grip;

the first sight assembly comprises a first sight bar and a first plurality of sight marks;

the second sight assembly comprises a second sight bar and a second plurality of sight marks;

the barrel grip being adjacently attached to the mount plate;

the first sight bar being pivotally connected to the mount plate by a first flanged brushing;

the second sight bar being pivotally connected to the mount plate by a second flanged brushing;

the first flanged brushing traversing though the first sight bar into the mounting plate;

the first sight bar being secured between a flange of the first flanged brushing and the mounting plate;

the second flanged brushing traversing through the second sight bar into the mount plate;

the second sight bar being secured between a flange of the second flanged brushing and the mount plate;

the first sight bar and the second sight bar being positioned opposite each other across the mount plate;

the first plurality of sight marks being adjacently attached to the first sight bar;

the first plurality of sight marks being positioned along the first sight bar;

the second plurality of sight marks being adjacently attached to the second sight bar;

the second plurality of sight marks being positioned along the second sight bar;

the barrel grip and mount plate forming an enclosure adapted to clamp around a barrel of a firearm;

the mount plate being a flat, rectangular piece;

the barrel grip being contoured as a negative of a shape of the barrel;

the barrel grip removable from the mount plate; and a first plurality of sight beads removably and threadably positioned along the first sight bar.

2. The firearm lead sight as claimed in claim 1 comprises:

the first and second sight bar being positioned opposite each other across the mounted plate;

the first and second sight bar positioned on the mount plate opposite the barrel grip;

the first sight bar and the second sight bar each comprise a proximal end and a distal end;

the proximal end of the first sight bar being pivotally connected to the mount plate;

the proximal end of the second sight bar being pivotally connected to the mount plate;

the distal ends of the first and second sight bars are detached form the mount plate; and the mount further comprises a plurality of first notches.

3. The firearm lead sight as claimed in claim 2 comprises:

the first sight bar comprises a first detent;

the plurality of first notches being positioned into the mount plate;

the first detent engaging a specific first notch from the plurality of first notches;

the first detent comprises a first spring and a first ball;

the first spring being positioned into the first sight bar and inside a cylindrical cavity;

the first ball attached to the first spring;

the first ball engaging the specific first notch;

the mount further comprises a plurality of set screws;

the plurality of set screws traversing through the barrel grip;

the plurality of set screws fastening the mount plate to the barrel grip;

the screws secured by threading bored into the barrel grip;

the barrel grip secured to the mount plate on a side of the barrel;

each of the plurality of set screws having a soft tip adapted to engage the barrel of the firearm; and the first sight bar and the second sight bar being positioned on the mount plate opposite the barrel grip.

4. The firearm lead sight as claimed in claim 3 comprises:

the mount further comprises a plurality of first notches and a plurality of second notches;

the plurality of first notches being radially positioned about the proximal end of the first sight arm; and the plurality of second notches being radially positioned about the proximal end of the second sight arm.

5. The firearm lead sight as claimed in claim 3 comprises:

the mount further comprises a plurality of second notches;

the second sight bar comprises a second detent;

the plurality of second notches being positioned into the mount plate; and the second detent engaging a specific second notch from the plurality of second notches.

6. The firearm lead sight as claimed in claim 5 comprises:

the second detent comprises a second spring and a first ball;

the second spring being positioned into the second sight bar;

a second ball being positioned adjacent to the second spring; and the second ball engaging the specific second notch.

7. A firearm lead sight comprises:

a mount;

a first sight assembly;

a second sight assembly;

the mount comprises a mount plate, a barrel grip, a plurality of first notches, and a plurality of second notches;

the first sight assembly comprises a first sight bar and a first plurality of sight marks;

the second sight assembly comprises a second sight bar and a second plurality of sight marks;

the second sight bar comprises a second detent;

the barrel grip being adjacently attached to the mount plate;

the first sight bar being pivotally connected to the mount plate by a first flanged brushing;

the second sight bar being pivotally connected to the mount plate by a second flanged brushing;

the first flanged brushing traversing though the first sight bar into the mounting plate;

the first sight bar being secured between a flange of the first flanged brushing and the mounting plate;

the second flanged brushing traversing through the second sight bar into the mount plate;

the second sight bar being secured between a flange of the second flanged brushing and the mount plate;

the first sight bar and the second sight bar being positioned opposite each other across the mount plate;

the first plurality of sight marks being adjacently attached to the first sight bar;

the first plurality of sight marks being positioned along the first sight bar;

the second plurality of sight marks being adjacently attached to the second sight bar;

the second plurality of sight marks being positioned along the second sight bar;

the barrel grip and mount plate forming an enclosure adapted to clamp around a barrel of a firearm;

the mount plate being a flat, rectangular piece;

the barrel grip being contoured as a negative of a shape of the barrel;

the barrel grip removable from the mount plate;

a first plurality of sight beads removably and threadably positioned along the first sight bar;

the first and second sight bar being positioned opposite each other across the mounted plate;

the first and second sight bar positioned on the mount plate opposite the barrel grip;

the first sight bar and the second sight bar each comprise a proximal end and a distal end;

the proximal end of the first sight bar being pivotally connected to the mount plate;

the proximal end of the second sight bar being pivotally connected to the mount plate;

the distal ends of the first and second sight bars are detached form the mount plate;

the mount further comprises a plurality of first notches;

the first sight bar comprises a first detent;

the plurality of first notches being positioned into the mount plate;

the first detent engaging a specific first notch from the plurality of first notches;

the first detent comprises a first spring and a first ball; and the first spring being positioned into the first sight bar and inside a cylindrical cavity.

8. The firearm lead sight as claimed in claim 7 comprises:

the first ball attached to the first spring;

the first ball engaging the specific first notch;

the mount further comprises a plurality of set screws;

the plurality of set screws traversing through the barrel grip;

the plurality of set screws fastening the mount plate to the barrel grip;

the screws secured by threading bored into the barrel grip;

the barrel grip secured to the mount plate on a side of the barrel; and each of the plurality of set screws having a soft tip adapted to engage the barrel of the firearm;

the plurality of second notches being positioned into the mount plate;

the second detent engaging a specific second notch from the plurality of second notches; and the first sight bar and the second sight bar being positioned on the mount plate opposite the barrel grip.

9. The firearm lead sight as claimed in claim 8 comprises:

the plurality of first notches being radially positioned about the proximal end of the first sight arm; and the plurality of second notches being radially positioned about the proximal end of the second sight arm.

10. The firearm lead sight as claimed in claim 8 comprises:

the second detent comprises a second spring and a first ball;

the second spring being positioned into the second sight bar;

a second ball being positioned adjacent to the second spring; and the second ball engaging the specific second notch.

11. A firearm lead sight comprises:

a mount;

a first sight assembly;

a second sight assembly;

the mount comprises a mount plate, a barrel grip, a plurality of first notches, and a plurality of second notches;

the first sight assembly comprises a first sight bar and a first plurality of sight marks;

the second sight assembly comprises a second sight bar and a second plurality of sight marks;

the first sight bar comprises a first detent and a proximal end;

the second sight bar comprises a second detent and a proximal end;

the barrel grip being adjacently attached to the mount plate;

the proximal end of the first sight bar being pivotally connected to the mount plate;

the proximal end of the second sight bar being pivotally connected to the mount plate;

the first sight bar and the second sight bar being positioned on the mount plate opposite the barrel grip;

the first sight bar and the second sight bar being positioned opposite each other across the mount plate;

the first plurality of sight marks being adjacently attached to the first sight bar;

the first plurality of sight marks being positioned along the first sight bar;

the second plurality of sight marks being adjacently attached to the second sight bar;

the second plurality of sight marks being positioned along the second sight bar;

the barrel grip and mount plate forming an enclosure adapted to clamp around a barrel of a firearm;

the mount plate being a flat, rectangular piece;

the barrel grip being contoured as a negative of a shape of the barrel;

the barrel grip removable from the mount plate;

a first plurality of sight beads removably and threadably positioned along the first sight bar;

the first and second sight bar being positioned opposite each other across the mounted plate;

the first and second sight bar positioned on the mount plate opposite the barrel grip;

the first sight bar and the second sight bar each comprise a proximal end and a distal end;

the proximal end of the first sight bar being pivotally connected to the mount plate;

the proximal end of the second sight bar being pivotally connected to the mount plate;

the distal ends of the first and second sight bars are detached form the mount plate;

the mount further comprises a plurality of first notches;

the first sight bar comprises a first detent;

the plurality of first notches being positioned into the mount plate;

the first detent engaging a specific first notch from the plurality of first notches;

the first detent comprises a first spring and a first ball;

the first spring being positioned into the first sight bar and inside a cylindrical cavity;

the first ball attached to the first spring;

the first ball engaging the specific first notch;

the mount further comprises a plurality of set screws;

the plurality of set screws traversing through the barrel grip;

the plurality of set screws fastening the mount plate to the barrel grip;

the screws secured by threading bored into the barrel grip;

the barrel grip secured to the mount plate on a side of the barrel;

each of the plurality of set screws having a soft tip adapted to engage the barrel of the firearm;

the plurality of first notches being radially positioned about the proximal end of the first sight arm;

the plurality of second notches being positioned into the mount plate;

the plurality of second notches being radially positioned about the proximal end of the second sight arm;

the second detent engaging a specific second notch from the plurality of second notches;

the second detent comprises a second spring and a first ball;

the second spring being positioned into the second sight bar;

a second ball being positioned adjacent to the second spring; and the second ball engaging the specific second notch.

* * * * *